US005592275A

United States Patent [19]

Echigo et al.

[11] Patent Number: 5,592,275

[45] Date of Patent: Jan. 7, 1997

[54] IMAGE FIXING DEVICE WITH OIL APPLICATION ROLLER FOR IMAGE FORMING APPARATUS

[75] Inventors: Katsuhiro Echigo, Asaka; Shigeo Kurotaka, Sagamihara, both of Japan

[73] Assignee: Ricoh Company, Ltd., Tokyo, Japan

[21] Appl. No.: 476,884

[22] Filed: Jun. 7, 1995

[30] Foreign Application Priority Data

Jul. 12, 1994 [JP] Japan ..... 6-160405

[51] Int. Cl.[6] ..... G03G 15/20

[52] U.S. Cl. ..... 399/325; 118/60; 399/327; 399/328

[58] Field of Search ..... 355/282–284; 118/60, DIG. 1

[56] References Cited

U.S. PATENT DOCUMENTS 4,352,551 10/1982 Iwao ..... 118/60 X 5,200,786 4/1993 Fromm et al. ..... 355/284

*Primary Examiner*—William J. Royer

*Attorney, Agent, or Firm*—Oblon, Spivak, McClelland, Maier & Neustadt, P.C.

[57] ABSTRACT

A fixing device incorporated in an image forming apparatus and for fixing a toner image on recording paper includes a fixing roller in which a heater is installed in the roller, a pressure roller which is held in press contact with the fixing roller, an oil application roller which is held in contact with the fixing roller for applying oil to the fixing roller, an oil supply roller which is held in contact with the oil application roller for applying oil to the oil application roller, an oil application felt which is held in contact with the oil supply roller for applying oil to the oil supply roller, and a driver which rotates the oil application roller such that the oil application roller moves in the same direction as the fixing roller at the contact portion between the fixing roller and the oil application roller. The surface velocity of the oil application roller is lower than the surface velocity of the fixing roller.

31 Claims, 8 Drawing Sheets

IMAGE FIXING DEVICE WITH OIL APPLICATION ROLLER FOR IMAGE FORMING APPARATUS

BACKGROUND OF THE INVENTION

1. Field of the Invention

The present invention relates to an image fixing device for a copier, printer or similar electrophotographic image forming apparatus. More particularly, the invention is concerned with an image fixing device for applying oil to a fixing roller.

2. Description of the Related Art

Japanese Patent Laid-Open Publication No. 5-27637 discloses an image fixing device as shown in FIG. 10. Referring to FIG. 10, the device includes a fixing roller 101, a pressure roller 102 which is in pressure contact with the fixing roller 101, an oil application roller 103 which is in pressure contact with the fixing roller 101 to apply an offset preventing oil 104, and an oil supply roller 105 which is in pressure contact with the oil application roller 103 to apply the oil. The fixing device has a motor 106 for driving the oil application roller 103 independently of the fixing roller 101. And the motor 106 is controlled to change the rotary speed of the oil application roller 103 according to the copying mode, for example full color mode or mono color mode, so as to keep a constant quantity of oil applied to the fixing roller 101. In that case, the quantity of oil applied to each sheet of transfer paper is about 25 mg.

In that fixing device, however, a motor is necessary to rotate the oil application roller. And the quantity of the oil applied to transfer paper, 25 mg, is too much. Furthermore, judging from the contact position of the oil application roller 103 on the fixing roller 101 and the rotating direction of the rollers 101 and 103, oil is liable to be collected at the nip between the fixing roller 101 and the oil application roller 103 during a standby state. Therefore when the fixing roller 101 rotates, collected oil is adhered to the roller 101, and a patch of oil is formed on the first fed paper.

In another conventional device, the offset preventing oil is directly applied from an oil application felt to the fixing roller, and the quantity of the oil is regulated by a blade contacting the fixing roller. In that device, paper dust and offset toner are accumulated at the contact portion of the felt and the blade. The surface of the fixing roller may therefore be damaged by excessive paper dust and offset toner.

SUMMARY OF THE INVENTION

Accordingly, it is an object of the present invention to provide an image fixing device for an image forming apparatus which can solve the aforementioned conventional drawbacks.

It is a further object of this invention to provide a novel fixing device for an image forming apparatus which can apply a suitable quantity of offset preventing oil to the fixing roller.

In order to achieve the above-mentioned and other objects, according to the present invention, a fixing device for fixing a toner image on recording paper includes a fixing roller in which a heater is installed in the roller, a pressure roller held in contact with the fixing roller, an oil application roller which is held in contact with the fixing roller for applying oil to the fixing roller, an oil supply roller which is held in contact with the oil application roller for applying oil to the oil application roller, an oil application felt which is held in contact with the oil supply roller for applying oil to the oil supply roller, and a driver which rotates the oil application roller such that the oil application roller moves in the same direction as the fixing roller at the contact portion between the fixing roller and the oil application roller, wherein the surface velocity of the oil application roller is slower than the surface velocity of the fixing roller.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
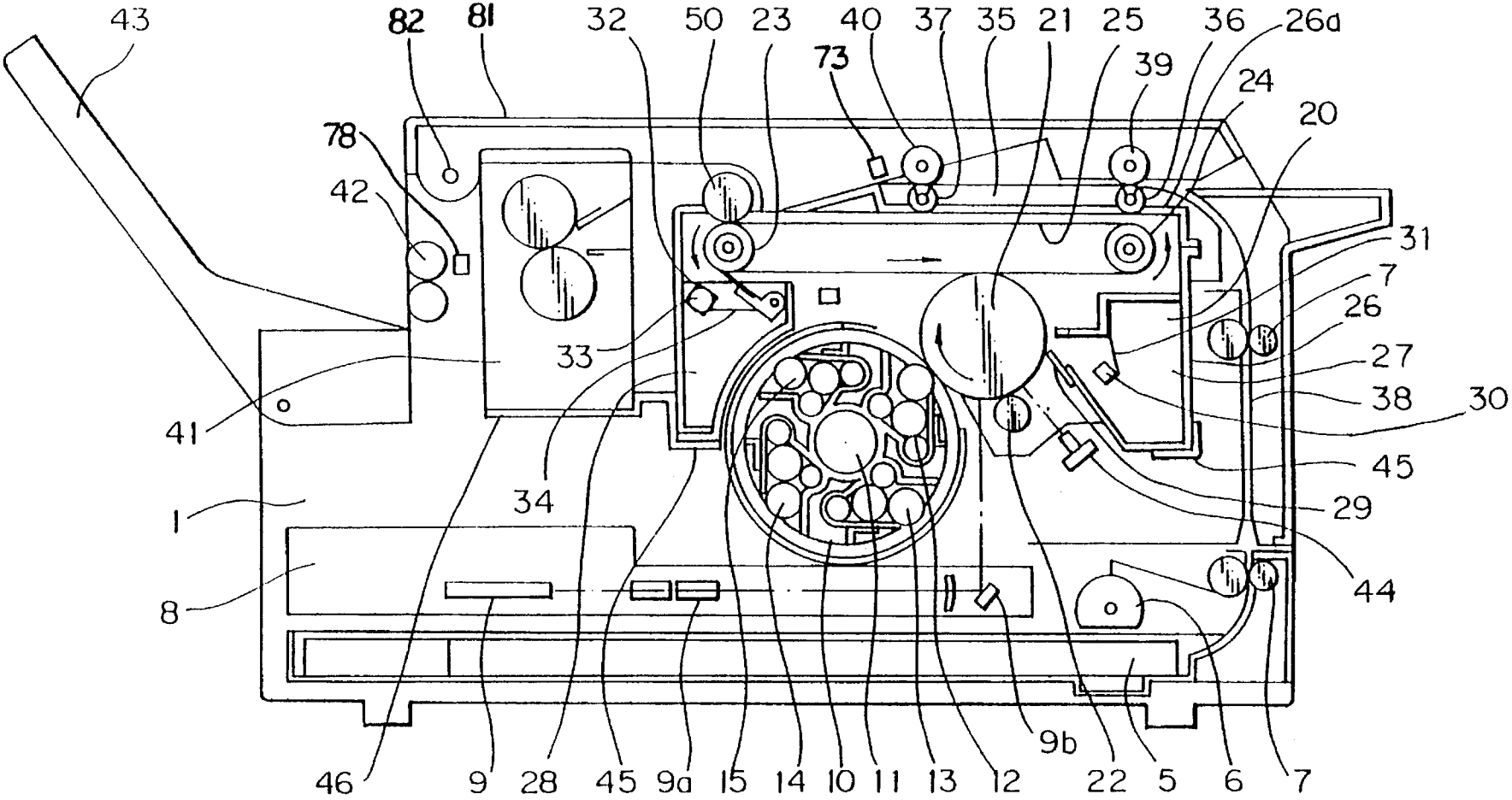
FIG. 1 is a front sectional view of a color image forming apparatus embodying the present invention.
Figure 2:
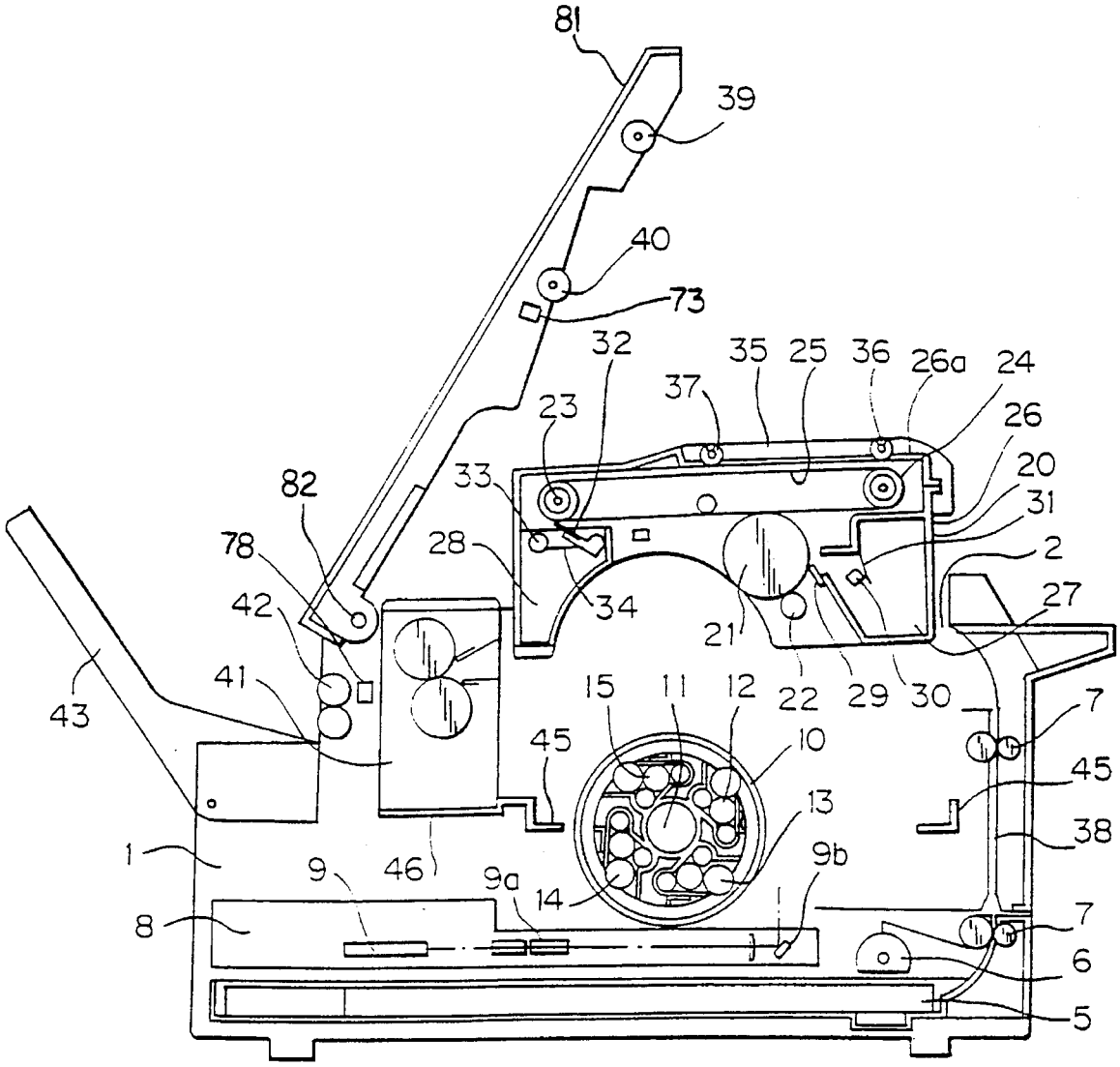
FIG. 2 is a view similar to FIG. 1, showing how a photoconductive element cartridge included in the embodiment is replaced.

Referring now to the drawings, wherein like reference numerals designate identical or corresponding parts throughout the several views, and more particularly to FIGS. 1 and 2 thereof, a color image forming apparatus embodying the present invention is shown and includes a body 1. As shown in FIGS. 1 and 2, the body 1 is formed with an opening 2 at the top thereof. A cover 81 is hinged to the body 1 at one edge of the opening 2 via a shaft 82. Also mounted on the body 1 are a sheet cassette 5, a pick-up roller 6 for pulling sheets out of the cassette 5 one by one, transport rollers 7 for conveying the sheet pulled out by the pick-up roller 6 and latent image forming means 8. In the illustrative embodiment, the latent image forming means 8 is implemented by a laser for emitting a laser beam, a rotatable polygonal mirror 9 for steering the laser beam, a f-theta lens 9*a*, and a mirror 9*b*. The laser beam steered by the polygonal mirror 9 is projected onto a photoconductive element via the f-theta lens 9*a* and mirror 9*b*. Alternatively, the latent image forming means 8 may be constituted by the combination of light emitting elements and converging light conducting elements arranged on a line.

A revolving type developing device 10 is disposed above the latent image forming means 8. The developing device 10 is made up of a plurality of developing units 12, 13, 14, and 15 which are mounted on a shaft, or movable support 11. The developing units 12–15 each store a developer of a particular color.

A photoconductive element cartridge 20 is located above the developing device 10. The cartridge 20 has a photoconductive element in the form of a drum 21, a charging member 22 held in contact with the drum 21, an intermediate transfer belt 25 which passes over a drive roller 23 and a driven roller 24 and is held in contact with the drum 21, and a casing or support 26 supporting the members 21–25. A lid 26*a* is mounted on the top of the casing 26 and may be opened. The casing 26 has a space 27 for collecting used toner from the drum 21, and a space 28 for collecting the used toner from the belt 25.

The toner collecting space 27 accommodates a cleaning blade 29 held in contact with the drum 21, a member 30 for driving the toner scraped off by the blade 29 into the space 27, and a member 31 for removing the toner deposited on the member 30. Likewise, the other toner collecting space 28 accommodates a cleaning blade 32 held in contact with the belt 25, a member 33 for driving the toner scraped off by the cleaning blade 32 into the space 28, and a member 34 for removing the toner deposited on the member 33.

A transport path is formed on the top of the lid 26*a* of the casing 26 to guide opposite edges of a sheet and is implemented by ribs. A transport roller 36 and a registration roller 37 are arranged on the transport path 35. The transport path 35 emerges from a sheet feed passage 38 which extends along one side of the body 1. A transport roller 39 and a registration roller 40 are mounted on the inner periphery of the cover 81 and held in contact with the above-mentioned transport roller 36 and the registration roller 37, respectively. A discharge lamp 44 is disposed in the cartridge 20 or in the body 1 so as to dissipate the charge of the drum 21, as needed.

A fixing device 41, discharge rollers 42 and a tray 43 are also mounted on the body 1. The fixing device 41 fixes a toner image transferred from the belt 25 to a sheet being transported. The sheet having the image fixed thereon is driven out to the tray 43 by the discharge rollers 42. A bracket 45 supporting the cartridge 20, a bracket, not shown, supporting the developing device 10, and a bracket 46 supporting the fixing device 41 extend out from the body 1. The brackets 45 and 46, as well as the bracket not shown, are positioned on the body 1 such that the cartridge 20, the developing device 10 and the fixing device 41 can be removed in this order; the cartridge 20 is remote from the shaft 82 supporting the cover 81.

Figure 3:
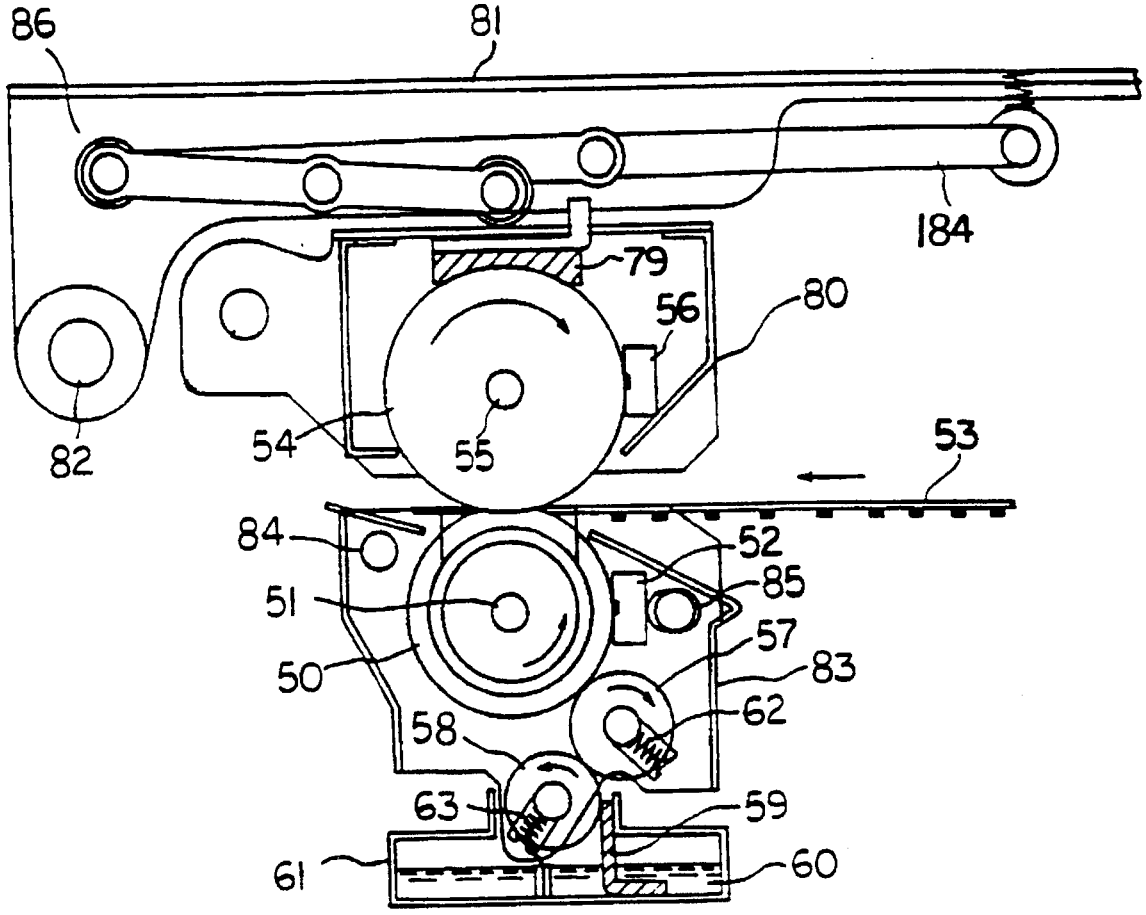
FIG. 3 is a sectional view of a fixing device embodying the present invention.

Referring to FIG. 3, which shows a fixing device according to the invention, a fixing roller 50 comprises a metal core and silicone rubber which is coated on the core. A heater 51 is disposed inside the fixing roller 50. The heater 51 is controlled in response to an output signal of a thermistor 52 which is held in contact with the fixing roller 50 such that the surface temperature of the fixing roller 50 is maintained at a predetermined temperature. The fixing roller 50 is disposed under a paper transport path and faces a toner image which is formed on a lower side of paper sheets moving on the transport path. A pressure roller 54 comprises a metal core and silicone rubber which is coated on the core. The pressure roller 54 is held in contact with the fixing roller 50. A heater 55 is disposed inside the pressure roller 54. The heater 55 is controlled in response to an output signal of a thermistor 56. The thermistor 56 is held in contact with the pressure roller 54 such that the surface temperature of the pressure roller 54 is maintained at a predetermined temperature.

An oil application roller 57 is held in contact with the lower surface of the fixing roller 50. The oil application roller 57 rotates such that the surface of the oil application roller 57 moves in the same direction as the surface of the fixing roller 50 at the contact portion with the fixing roller 50. The oil application roller 57 rotates slower than the fixing roller 50, so the surface of the fixing roller 50 is coated with oil uniformly.

Figure 4:
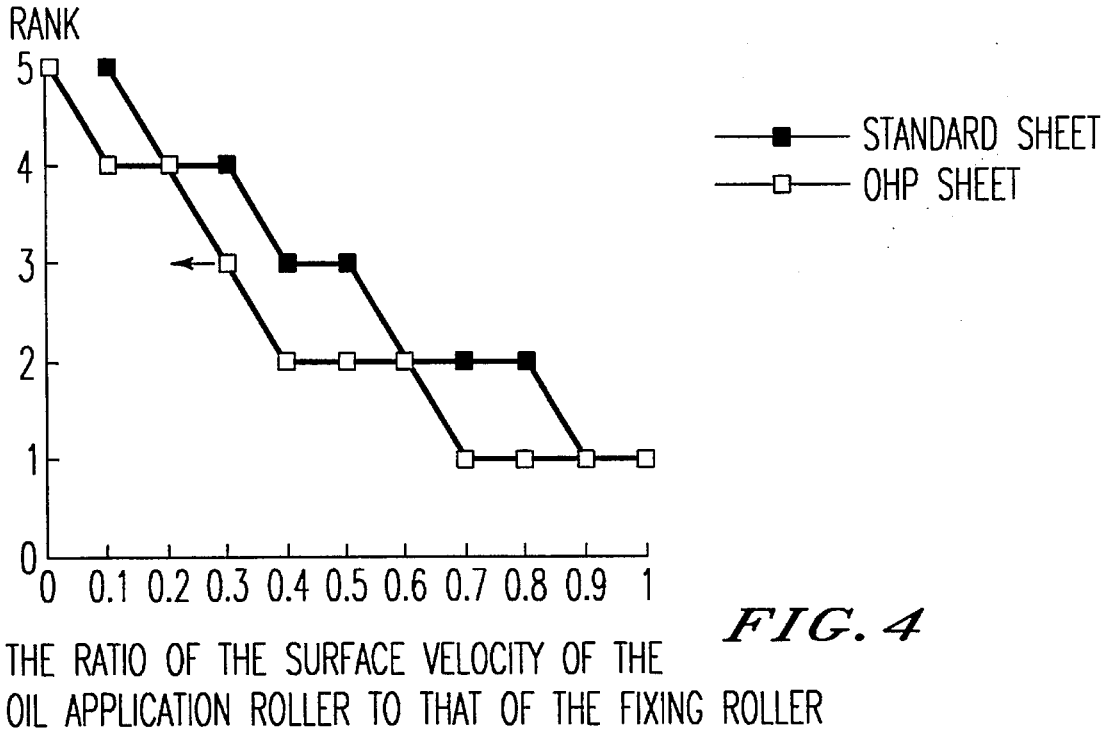
FIG. 4 is a graphical representation of a relation between a ratio of surface velocity of an oil application roller to that of a fixing roller, and oil application quality.
Figure 5:
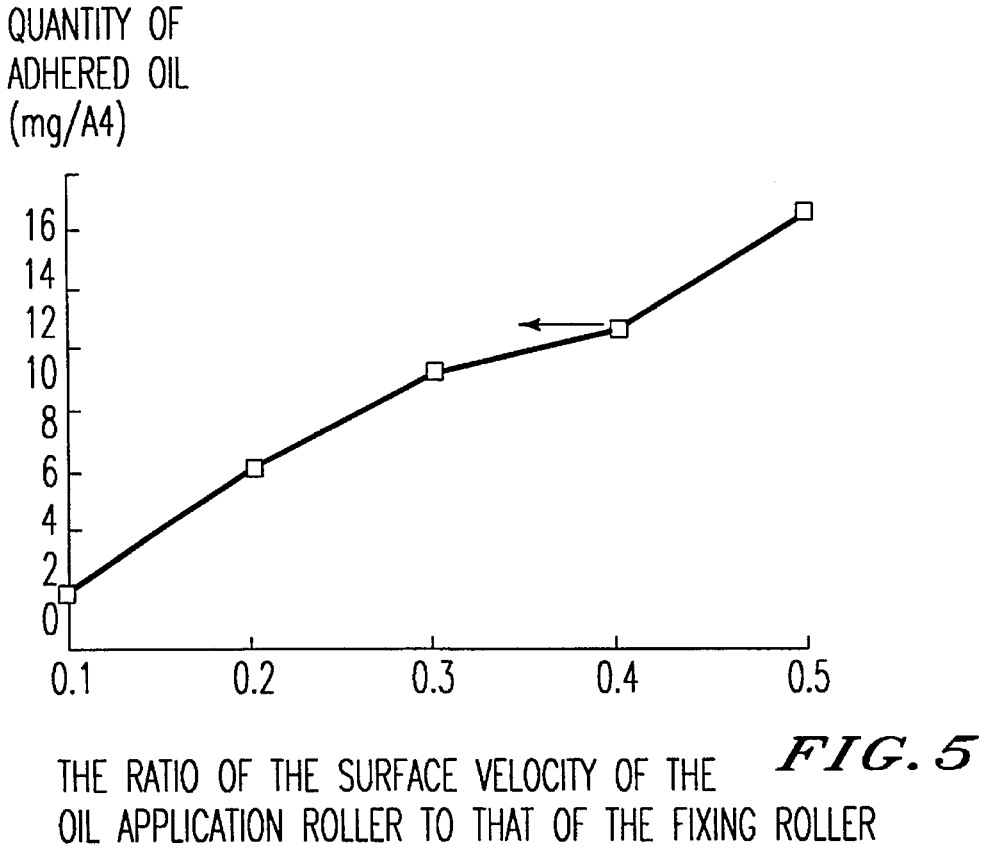
FIG. 5 is a graphical representation of a relation between the ratio of FIG. 4 and a quantity of the oil application.

The relation between the ratio of the surface velocity of the oil application roller 57 to that of the fixing roller 50 and the state of adhered oil on paper was experimentally examined using overhead projector sheets (OHP sheets) as the paper. The results of the experiments are shown in FIGS. 4 and 5. Referring to FIGS. 4 and 5, a rank of 3 or more indicates a good condition and quantity of adhered oil on the OHP sheet. The rank of 3 or more corresponds to an oil quantity of from 2 mg to 10 mg per sheet of A4 paper.

Therefore, as shown in FIGS. 4 and 5, when the ratio of the surface velocity of the oil application roller 57 to that of the fixing roller 50 is 0.3 or less, the state of oil adhesion is good. When the ratio is 0.3, the quantity of adhered oil per a sheet of paper is about 10 mg. If the quantity of adhered oil is significantly less, toner offset may occur. As a result of these experiments, the lower permissible limit of the quantity of the adhered oil was found to be 2 mg per A4 size of paper, and it was determined that the ratio of the surface velocity of the oil application roller to the fixing roller corresponding to that quantity was 0.1. Therefore, it is desirable that the oil application roller 57 rotates such that the surface of the roller 57 moves in the same direction as the surface of the fixing roller at the contact portion, and the surface velocity ratio of the roller 57 to the roller 50 is from 0.1 to 0.3.

Referring to FIG. 3, an oil supply roller 58 is held in contact with the lower portion of the oil application roller 57. The oil supply roller 58 applies offset preventing oil to the oil application roller 57. An oil application felt 59 is held in contact with the oil supply roller 58. The oil application felt 59 applies oil to the oil supply roller 58. The oil application felt 59 is disposed inside an oil tank 61 which stores oil. Oil in the oil tank 61 permeates the oil application felt 59 and is applied to the oil supply roller 58. The ratio of the surface velocity of the oil application roller to that of the fixing roller is from 0.1 to 0.3, so the oil application roller 57 uniformly applies offset preventing oil to the fixing roller 50. Therefore toner offset to the fixing roller is prevented and the lifetime of the fixing roller becomes long.

Referring to FIG. 3, both end portions of a shaft of the oil application roller 57 are pressed to the fixing roller 50 by springs 62. In an experiment, the pressure was changed from 0.5 kgf to 5 kgf. As a result of the experiment, it was found that when the pressure was weak, the quantity of applied oil was small. When the pressure was 4 kgf or more, the load required to rotate the rollers was high. However, when the pressure was from 0.5 kgf to 2 kgf, the load to rotate the rollers was low and the quantity of applied oil was uniform. Furthermore, as a result of the experiments, it was found that when the surface roughness of the fixing roller 50 and the oil application roller 57 was low, toner offset was prevented even if the quantity of applied oil was small and the state of the applied oil was uniform. It is thus desirable that the surface roughness of the fixing roller 50 and the oil application roller 57 is 4 μm or less.

As shown in FIG. 3, both end portions of a shaft of the oil supply roller 58 are pressured to the oil application roller 57 by springs 63. The oil application felt 59 is held in contact with the oil supply roller 58 so as to apply silicone oil to the roller 58. When oil on the oil application roller 57 diminishes, the oil supply roller 58 is rotated by contact with the oil application roller 57 since the coefficient of friction between the rollers becomes high, and silicone oil is thereby applied from the oil supply roller 58 to the oil application roller 57. When the quantity of the oil on the oil application roller 57 becomes enough, the oil supply roller 58 stops rotating. That is to say, when sufficient oil is applied to the oil application roller 57, the oil supply roller 58 stops rotating since the coefficient of friction at the contact portion of the two rollers becomes low. Then application of oil to the oil application roller 57 stops. As a result of the experiments, it was found that when the pressure of the oil supply roller 58 onto the oil application roller 57 is from 0.5 kgf to 2 kgf and the surface roughness of the oil supply roller 58 is 4 μm or less, the quantity of applied oil to the oil application roller 57 is appropriate.

The viscosity of the oil affects its ability to prevent offset. As a result of experiments, it was found that when the viscosity of the oil was low, toner offset could be prevented even if the quantity of oil on the fixing roller 50 was small. In the present embodiment, when the viscosity of the oil was 300CS at 25° C. or less, more desirably 100CS at 25° C. or less, the quantity of applied oil was uniform.

Figure 6:
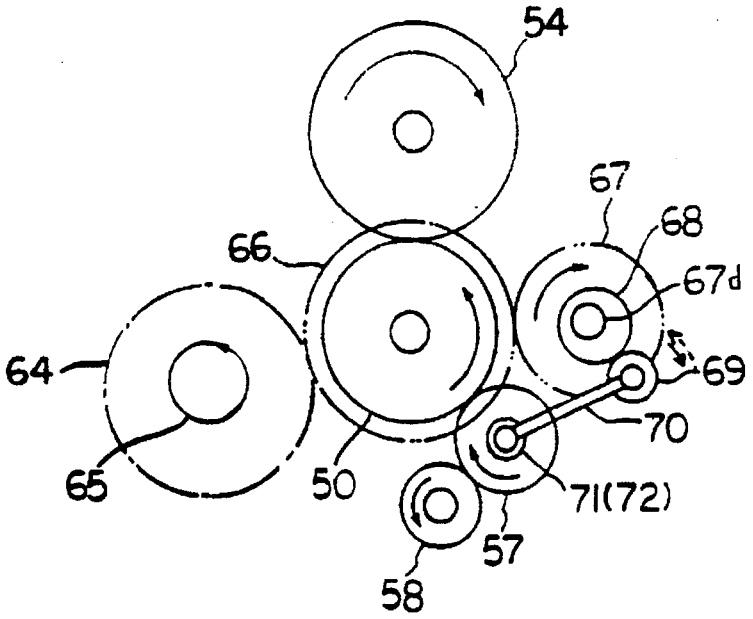
FIG. 6 is a schematic sectional view showing a structural member of a fixing drive member embodying the present invention.

FIG. 6 shows a driving member of the fixing roller 50 and the oil application roller 57. Referring to FIG. 6, a fixing roller driving gear 66, which is united with the fixing roller 50 and drives the roller 50, meshes with a driving gear 64. The driving gear 64 is connected with a driving motor via a clutch 65. The fixing roller driving gear 66 drives the oil application roller 57 via an oil application roller driving member. The oil application roller driving member comprises an intermediate gear 67, a cam 68 which is fixed on a shaft 67*d* of the intermediate gear 67, a cam follower 69 which is held in pressured contact with the cam 68, a lever 70 whose one end is fixed on the cam follower 69, and a one-way clutch 71 which is fixed on another end of the lever 70 and positioned on a shaft 72 of the oil application roller 57 so that rotation of the lever about the shaft 72 in the solid line arrow direction rotates the shaft 72. The intermediate gear 67 is held in mesh with the fixing roller driving gear 66. The oil application roller driving member intermittently drives the oil application roller 57 during rotation of the fixing roller 50.

In operation, when the clutch 65 is turned off, driving power from the motor is stopped, so the fixing roller driving gear 66 and the fixing roller 50 stop rotating. Meanwhile, when the clutch 65 is turned on, driving power is transmitted to the fixing roller driving gear 66 via the driving gear 64, so the fixing roller 50 rotates. When the fixing roller driving gear 66 rotates, driving power is transmitted to the cam 68 via the intermediate gear 67 so that the cam 68 rotates in the direction of the solid arrow. The cam follower 69 moves in accordance with the rotation of the cam 68. When the cam follower 69 moves away from the shaft 67*d*, the lever 70 rotates about shaft 72 in the direction of the solid arrow. Rotation of the lever 70 is transmitted to the shaft 72 via the one-way clutch 71, causing the oil application roller 57 to rotate by a predetermined angle. When the lever moves in the direction indicated by the dotted arrow, the one way clutch causes the oil application roller 57 not to rotate. Therefore the oil application roller 57 rotates intermittently. The oil application roller 57 thus rotates slower than the fixing roller 50.

As mentioned above, when the ratio of the surface velocity of the oil application roller 57 to that of the fixing roller 50 is from 0.1 to 0.3, the quantity of applied oil on the paper is good. However, excessive oil is adhered to the first paper after image forming operation is started as follows:

1. As the temperature of the fixing roller 50 becomes high after electric power is turned on, oil which is impregnated in the layer of the silicone rubber of the fixing roller 50 transudes. The oil is gathered at the nip portion between the fixing roller 50 and the pressure roller 54. Oil is adhered to the first sheet after the paper feed is started such that a line of oil is adhered to the paper for a length corresponding to the circumference of the roller 50.

2. If the fixing roller 50 rotates for a long time before the fed paper reaches the fixing portion, the quantity of applied oil to the fixing roller 50 increases. As a result, excessive oil is adhered to paper for the length of circumference of the roller 50 from the lead edge of paper.

In accordance with the present embodiment, these aforementioned drawbacks are eliminated by controlling the operation of the clutch 65.

Figure 7:
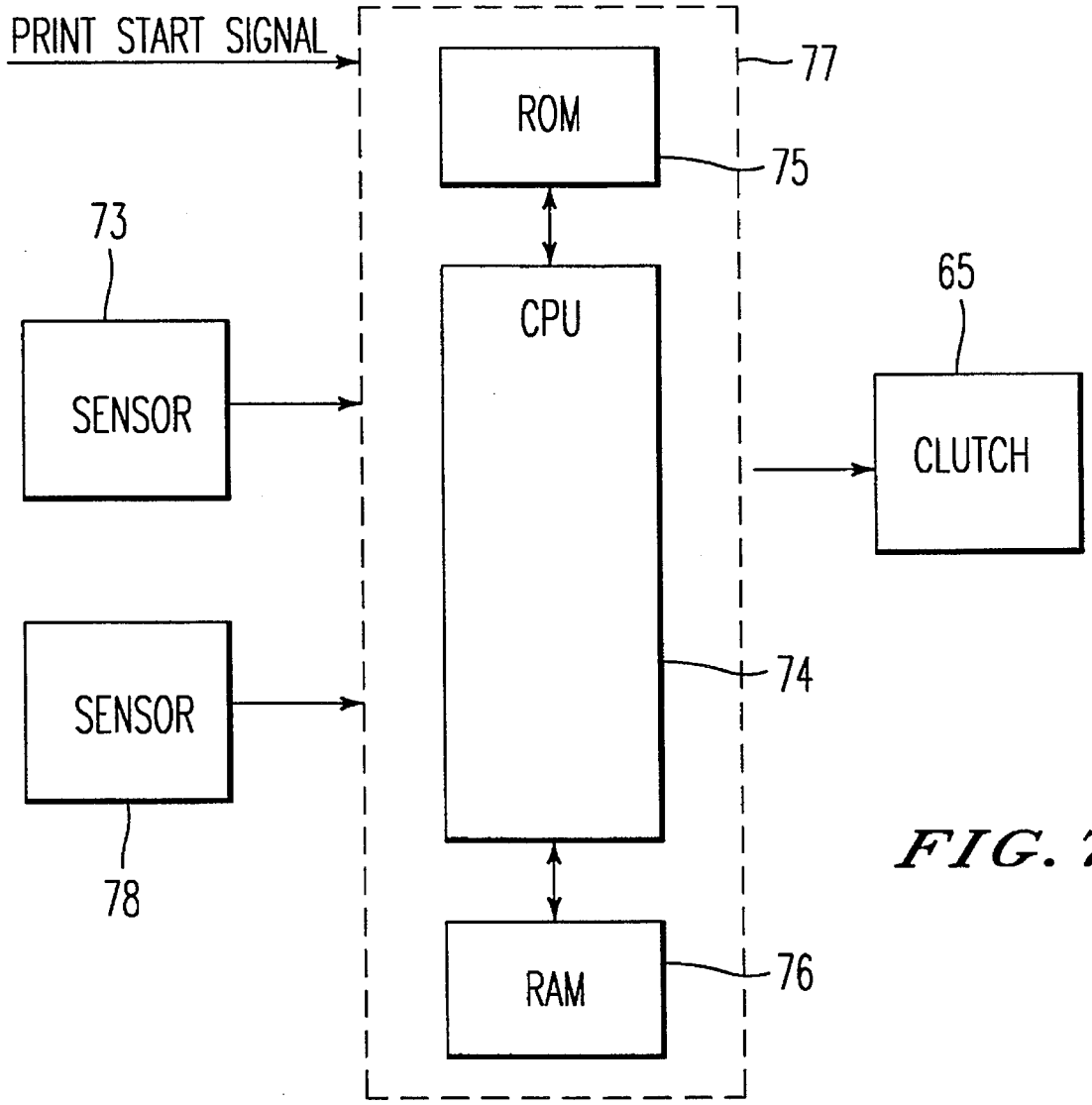
FIG. 7 is a block diagram of the fixing drive member embodying the present invention.

As a result of experiments, it was found that the first drawback is eliminated by rotating the fixing roller 50 for 10 seconds or more before the first paper reaches the fixing portion. As for the second drawback, it is eliminated by rotating the fixing roller 50 for 20 seconds or slightly less before the first paper sheet reaches the fixing portion. Therefore, the aforementioned drawbacks are resolved by rotating the fixing roller 50 from 10 to 20 seconds before the first paper reaches the fixing portion. As shown in FIG. 7, a controller 77 can receive, from an external source such as a manually actuated print start controller, a print start signal for printing a predetermined number of copies. The controller 77 comprises a central processing unit 74, a read only memory 75 and a random access memory 76. A timer which is in the central processing unit 74 starts to count in response to the inputted print start signal. When the timer counts a predetermined period, the controller 77 outputs a signal to turn on the clutch 65. Then the fixing roller 50 starts to rotate to feed paper sheets for copying.

Excessive oil is adhered not only to the first paper but also the following paper if an interval of successive sheets is 20 seconds or more. In the present embodiment, for resolving this drawback, the fixing roller 50 rotates for 20 seconds after the sensor 73 detects the rear edge of a paper sheet. Then the roller 50 stops rotating until the sensor detects the following paper.

Excessive oil is also adhered to a paper sheet if the fixing roller 50 rotates for a long time after the last paper sheet passes through the fixing roller. So the fixing roller 50 needs to stop rotating immediately after a paper sheet is discharged. As shown in FIG. 7, the clutch 65 is turned off by the controller, thereby finishing the image forming operation, when a sensor 78 detects the rear edge of the last of the predetermined number of copies.

Figure 8:
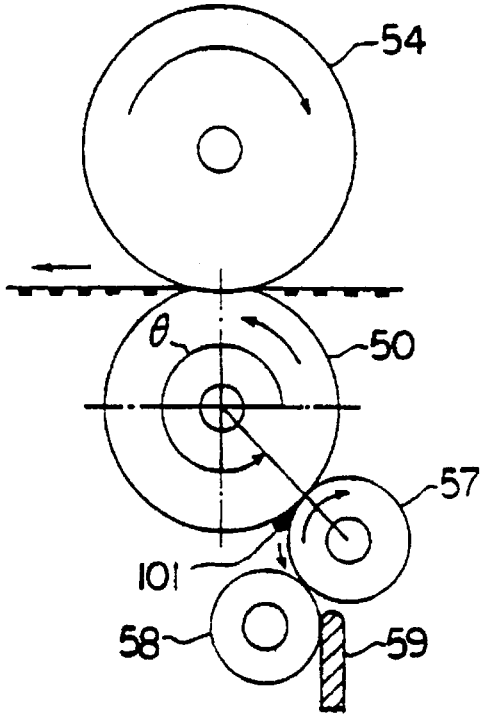
FIG. 8 is a schematic sectional view of the fixing device embodying the present invention.

FIG. 8 shows a schematic view of the fixing device. Referring to FIG. 8, when the fixing roller 50 rotates in a counterclockwise direction, the oil application roller 57 is held in contact with the fixing roller 50 at an angle θ from 270° to 360°. In accordance with the present embodiment, since the contact portion of the fixing roller 50 and the oil application roller 57 is below the rotational center of the fixing roller, oil 101 which is gathered there drops onto the application roller, so it is prevented that excessive oil adheres to the fixing roller 50. As a modified embodiment, when the fixing roller rotates in a clockwise direction, the oil application roller is held in contact with the fixing roller at an angle θ from 180° to 270°.

Referring to FIG. 3, offset toner from paper to the fixing roller 50 is cleaned as follows:

Offset preventability to toner of the fixing roller 50 is equal with or better than that of the oil application roller 57. So toner on the fixing roller 50 is captured by the oil application roller 57 to some degree. Since offset preventability to toner of the oil application roller 57 is equal with or better than that of the oil supply roller 58, toner on the oil application roller 57 is captured by the oil supply roller 58. Then offset toner on the oil supply roller 58 is captured by the oil application felt 59. The oil application felt 59 is disposed in an oil tank 61. When the silicone oil in the oil tank 61 is used up, the oil tank 61 is removed from the image forming apparatus together with the oil application felt 59. The ability of cleaning of the oil application felt 59 is thereby recovered.

A small amount of offset toner on the fixing roller 50 which cannot be captured by the oil application roller 57 is captured by paper sheet 53 passing through the fixing roller 50. Since a small amount of toner is thus captured by the paper, the oil application felt 59 is not choked with offset toner and its ability to apply oil remains stable.

Figure 9:
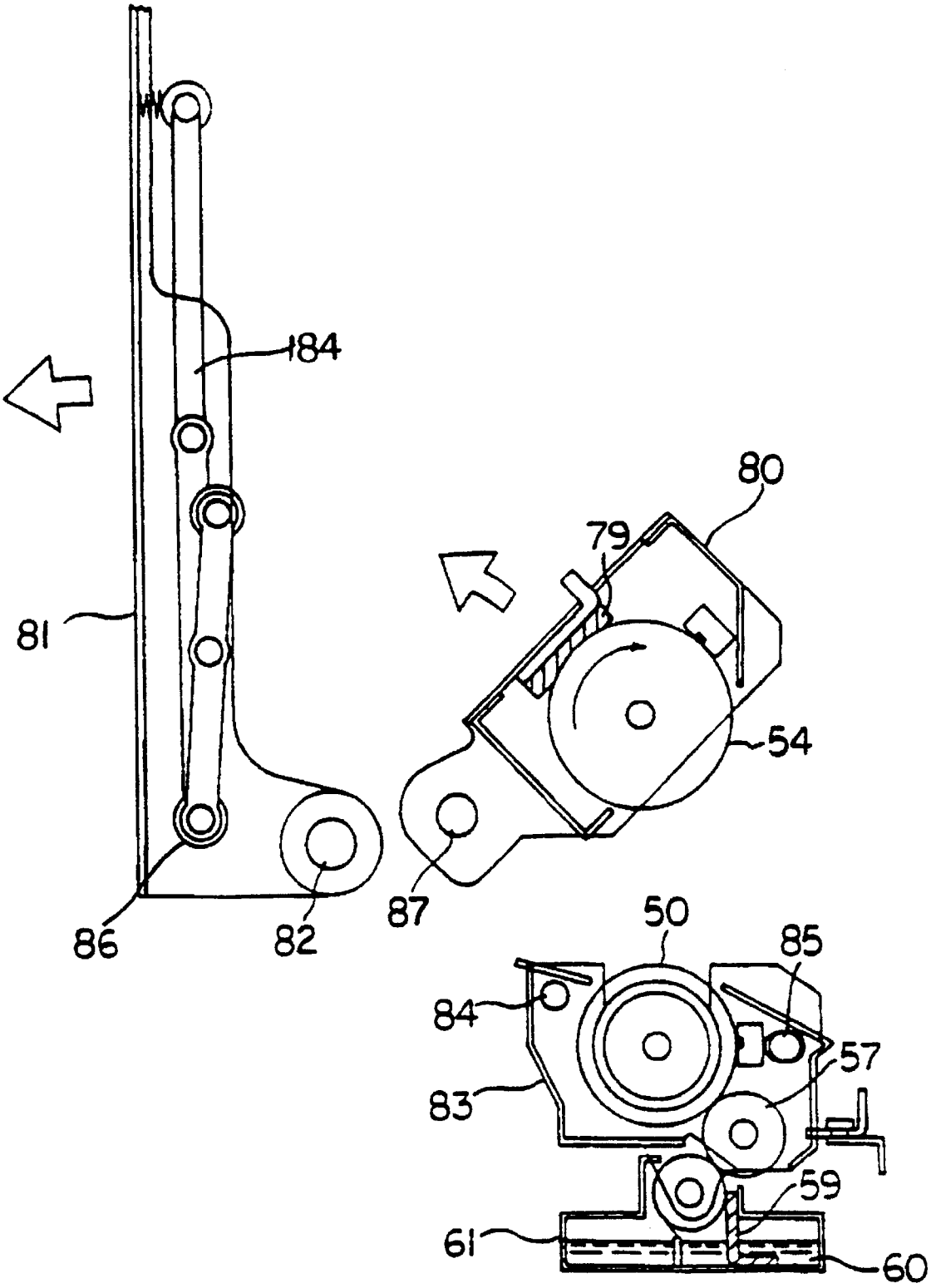
FIG. 9 is a view showing how the fixing device included in the embodiment is replaced.
Figure 10:
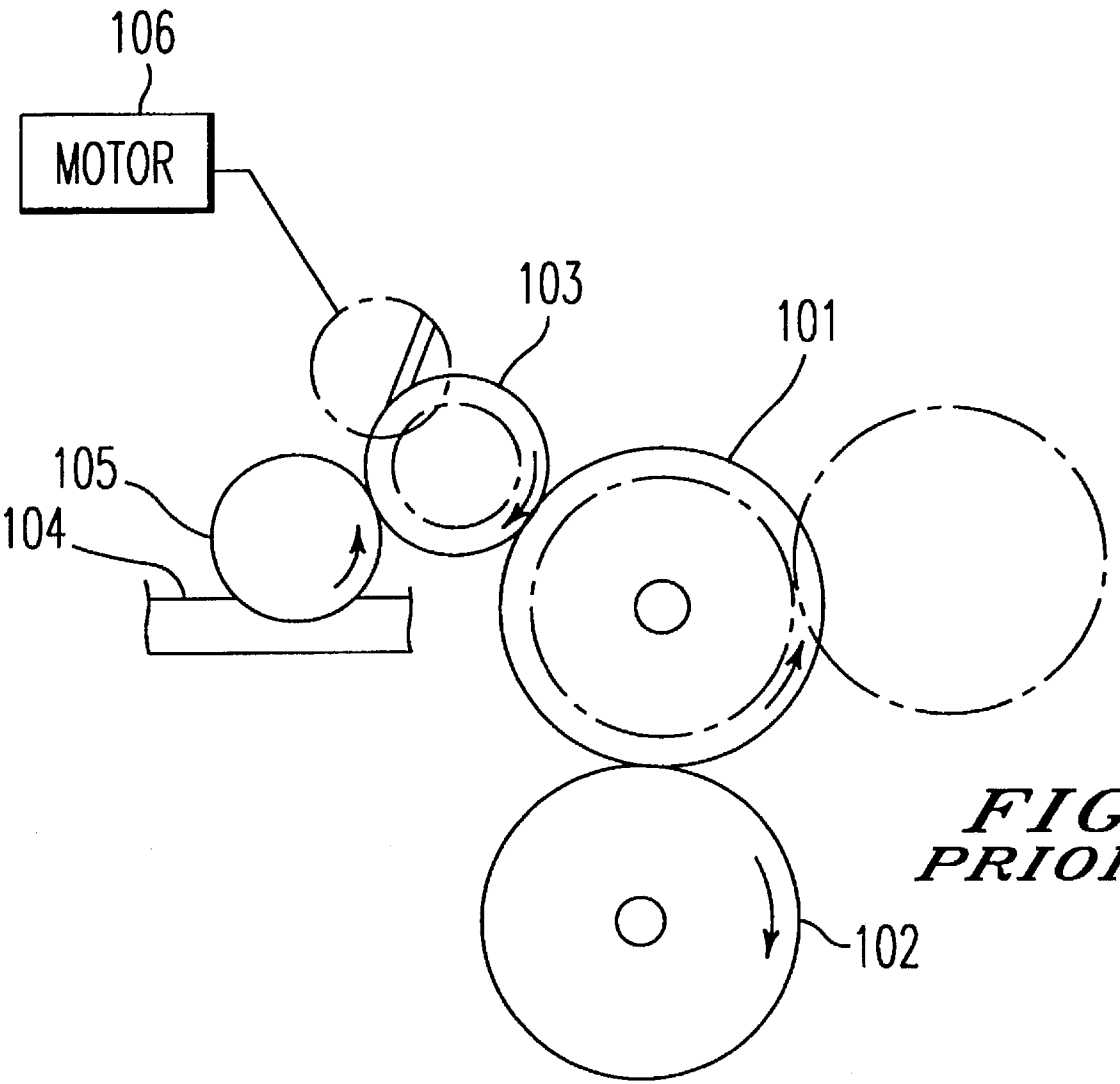
FIG. 10 PRIOR ART
FIG. 10 is a schematic sectional view of a fixing device of the prior art.

Offset preventability of the pressure roller 54 is not better than that of the fixing roller 50. So offset toner on the fixing roller 50 is captured by the pressure roller when both of rollers 50 and 54 rotate and paper is absent. Offset toner on the pressure roller 54 is captured by a cleaning member 79 which is held in contact with the upper portion of the roller 54. The cleaning member 79 is removable from the upper portion of a pressure roller unit 80. As shown in FIGS. 3 and 9, an outer cover 81 is opened centering around a shaft 82. The cleaning member 79 may then be removed from the upper portion of the pressure roller unit 80. In operation, the outer cover 81 is opened and the cleaning member 79 is removed, and then a new one is installed. In accordance with the present embodiment, the cleaning ability of the cleaning member 79 remains stable.

Referring to FIGS. 3 and 9, the fixing device has the pressure roller unit 80 in which the pressure roller 54 is disposed and a fixing roller unit 83 in which the fixing roller 50 and the oil application roller 57 are disposed. The pressure roller unit 80 and the fixing roller unit 83 are separate from each other. The outer cover 81 in which a pressure mechanism 184 is installed is positioned over and presses on the pressure roller unit 80. The fixing roller unit 83 is fixed on the image forming apparatus by pins 84 and 85. The shaft 82 of the outer cover 81 is positioned on the image forming apparatus, and a shaft 86 of the pressure mechanism 184 is positioned at the outer cover 81.

In order to remove the pressure roller unit 80 and the fixing roller unit 83, the outer cover 81 is opened. When the outer cover 81 is opened, pressure on the pressure roller unit 80 by the pressure mechanism 184 is released. At the same time pressure on the fixing unit is also released. Then the pressure roller unit 80 is removable toward the upper portion of the image forming apparatus. After that the fixing roller unit 83 is similarly removable. The oil tank 61 is also removable together with the oil application felt 59 and oil 60. In accordance with the present embodiment, maintenance of the fixing device becomes easy.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fixing device for fixing a toner image on recording paper comprising:

a fixing roller including a heater;

a pressure roller held in press contact with said fixing roller;

an oil application roller contacting said fixing roller for applying oil to said fixing roller;

an oil supply roller contacting said oil application roller for applying said oil to said oil application roller;

an oil application felt contacting said oil supply roller for applying said oil to said oil supply roller; and a driver drivingly connected to said oil application roller so as to rotate said oil application roller such that said oil application roller moves in the same direction as said fixing roller at a contact portion between said fixing roller and said oil application roller, and such that a surface velocity of said oil application roller is lower than a surface velocity of said fixing roller.

2. A fixing device as claimed in claim 1, wherein a ratio of the surface velocity of said oil application roller to that of said fixing roller is from 0.1 to 0.3.

3. A fixing device as claimed in claim 1, wherein a pressure of said oil application roller onto said fixing roller is from 0.5 kgf to 2 kgf and a surface roughness of each of said pressure and oil application rollers is 4 μm or less.

4. A fixing device as claimed in claim 1, wherein said oil application roller drives said oil supply roller by friction at a contact portion between said oil application roller and said oil supply roller.

5. A fixing device as claimed in claim 4, wherein a pressure of said oil supply roller onto Said oil application roller is from 0.2 kgf to 2 kgf, and the surface roughness of said oil supply roller is 4 μm or less.

6. A fixing device as claimed in claim 1, wherein said oil is silicone oil and a viscosity of said oil is 300CS or less.

7. A fixing device as claimed in claim 1, wherein an offset preventability to toner of said fixing roller, said oil application roller and said oil supply roller is as follows:

the fixing roller≧the oil application roller≧the oil supply roller.

8. A fixing device as claimed in claim 7, wherein said oil application felt is removable from said fixing device.

9. A fixing device as claimed in claim 1, wherein offset preventability to toner of said fixing roller and said pressure roller is as follows:

the fixing roller≧the pressure roller.

10. A fixing device as claimed in claim 9, further comprising a cleaning member contacting said pressure roller.

11. A fixing device as claimed in claim 1, wherein a contacting portion between said oil application roller and said fixing roller is at a counterclockwise angle of from 270° to 360° with respect to a horizontal line intersecting a rotational center of said fixing roller when said fixing roller rotates in a counterclockwise direction.

12. A fixing device as claimed in claim 1, wherein a contacting portion between said oil application roller and said fixing roller is at a counterclockwise angle of from 180° to 270° with respect to a horizontal line intersecting a rotational center of said fixing roller when said fixing roller rotates in a clockwise direction.

13. A fixing device as claimed in claim 1, further comprising an outer cover which covers at least one portion of said fixing device, wherein when said outer cover is opened, pressure between said fixing roller and said pressure roller is released.

14. A fixing device as claimed in claim 13, wherein said pressure roller is removable from said fixing device, and said fixing roller is removable from said fixing device together with said oil application roller after said pressure roller is removed.

15. A fixing device as claimed in claim 14, further comprising an oil supply unit including an oil tank and an oil application felt, said oil supply unit being removable from said fixing device.

16. A fixing device for fixing a toner image on recording paper comprising:

a fixing roller;

a pressure roller held in press contact with said fixing roller;

an oil application roller having a predetermined surface roughness and contacting said fixing roller for applying offset preventing oil to said fixing roller; and a driver drivingly connected to said oil application roller so as to rotate said oil application roller such that said oil application roller moves in the same direction as said fixing roller at a contact portion between said fixing roller and said oil application roller, and such that a surface velocity of said oil application roller is lower than a surface velocity of said fixing roller.

17. A fixing device as claimed in claim 16, wherein a ratio of the surface velocity of said oil application roller to that of said fixing roller is from 0.1 to 0.3.

18. A fixing device as claimed in claim 16, wherein a pressure of said oil application roller onto said fixing roller is from 0.5 kgf to 2 kgf and a surface roughness of each of said pressure and oil application rollers is 4 μm or less.

19. A fixing device as claimed in claim 16, wherein said oil application roller drives said fixing roller by friction at a contact portion between said oil application roller and said fixing roller.

20. A fixing device as claimed in claim 16, wherein a contacting portion between said oil application roller and said fixing roller is at a counterclockwise angle of from 270° to 360° with respect to a horizontal line intersecting a rotational center of said fixing roller when said fixing roller rotates in a counterclockwise direction.

21. A fixing device as claimed in claim 16, wherein a contacting portion between said oil application roller and said fixing roller is at a counterclockwise angle of from 180° to 270° with respect to a horizontal line intersecting a rotational center of said fixing roller when said fixing roller rotates in a clockwise direction.

22. An image forming apparatus for forming a toner image on recording paper and fixing said toner image on said recording paper, comprising:

an image forming portion;

a fixing roller including a heater and positioned for receiving a paper sheet having an image thereon from said image forming portion;

a pressure roller held in press contact with said fixing roller;

an oil application roller contacting said fixing roller for applying oil to said fixing roller;

an oil supply roller contacting said oil application roller for applying said oil to said oil application roller;

an oil application felt contacting said oil supply roller for applying said oil to said oil supply roller; and a driver drivingly connected to said oil application roller so as to rotate said oil application roller such that said oil application roller moves in the same direction as said fixing roller at a contact portion between said fixing roller and said oil application roller, and such that a surface velocity of said oil application roller is lower than a surface velocity of said fixing roller.

23. An image forming apparatus as claimed in claim 22, wherein a ratio of the surface velocity of said oil application roller to that of said fixing roller is from 0.1 to 0.3.

24. An image forming apparatus as claimed in claim 22, wherein a pressure of said oil application roller onto said fixing roller is from 0.5 kgf to 2 kgf and a surface roughness of each of said pressure and oil application rollers is 4 μm or less.

25. An image forming apparatus as claimed in claim 22, wherein said oil application roller drives said oil supply roller by friction at a contact portion between said oil application roller and said oil supply roller.

26. An image forming apparatus as claimed in claim 22, wherein a contacting portion between said oil application roller and said fixing roller is at a counterclockwise angle of from 270° to 360° with respect to a horizontal line intersecting a rotational center of said fixing roller when said fixing roller rotates in a counterclockwise direction.

27. An image forming apparatus as claimed in claim 22, wherein a contacting portion between said oil application roller and said fixing roller is at a counterclockwise angle of from 180° to 270° with respect to a horizontal line intersecting a rotational center of said fixing roller when said fixing roller rotates in a clockwise direction.

28. An image forming apparatus as claimed in claim 22, including a controller operatively connected to said fixing roller so as to control the rotation of said fixing roller in response to a paper sheet fed from said image forming portion.

29. An image forming apparatus as claimed in claim 28, wherein said controller comprises means for rotating said fixing roller for a predetermined period before a first paper sheet from said image forming portion reaches said fixing roller after an image forming operation starts.

30. An image forming apparatus as claimed in claim 28, wherein said controller comprises means for rotating said fixing roller for a predetermined period after a paper sheet passes through said fixing roller and before a following paper sheet reaches said fixing roller from said image forming portion.

31. An image forming apparatus as claimed in claim 28, wherein said controller comprises means for stopping rotation of said fixing roller after a last paper sheet of an image forming operation passes through said fixing roller.

* * * * *